US005499455A

United States Patent [19]

Palmer

[11] Patent Number: 5,499,455

[45] Date of Patent: Mar. 19, 1996

[54] PORTABLE RETICLE ALIGNMENT DEVICE FOR FIREARMS

[76] Inventor: Michael R. Palmer, Nine Somerset Dr., Suffern, N.Y. 10901

[21] Appl. No.: 433,239

[22] Filed: May 2, 1995

Related U.S. Application Data

[63] Continuation-in-part of Ser. No. 92,395, Jul. 15, 1993.

[51] Int. Cl.[6] ..... G01B 11/26

[52] U.S. Cl. ..... 33/233; 33/241; 33/DIG. 21; 356/153

[58] Field of Search ..... 33/233, 234, 241, 33/DIG. 21, 286; 356/138, 153

[56] References Cited

U.S. PATENT DOCUMENTS

| | | | |
|---|---|---|---|
| 3,801,205 | 4/1974 | Eggenschwyler | 33/DIG. 21 |
| 3,873,823 | 3/1975 | Northrup et al. | 356/138 X |
| 5,040,885 | 8/1991 | Simms | 33/241 X |
| 5,367,779 | 11/1994 | Lee | 33/DIG. 21 |

FOREIGN PATENT DOCUMENTS

| | | | |
|---|---|---|---|
| 2186062 | 8/1987 | United Kingdom | 33/233 |

*Primary Examiner*—Alvin Wirthlin
*Attorney, Agent, or Firm*—Darby & Darby

[57] ABSTRACT

A device for aiding in the cross-hair alignment of the reticle of a gun-mounted telescopic sight wherein the gun includes at least one scope base for securing the telescopic sight. The device includes a light source for projecting a beam of light against a surface. The light source is mounted to the scope base of the gun. The projected light beam is modified to form a reference line which may be viewed through the telescopic sight. The projected reference line is automatically aligned with the barrel axis of the gun. One of the cross-hairs of the reticle of the telescopic sight may be compared with the aligned projected reference line and adjusted accordingly to align the cross-hairs with the barrel axis of the gun.

1 Claim, 9 Drawing Sheets

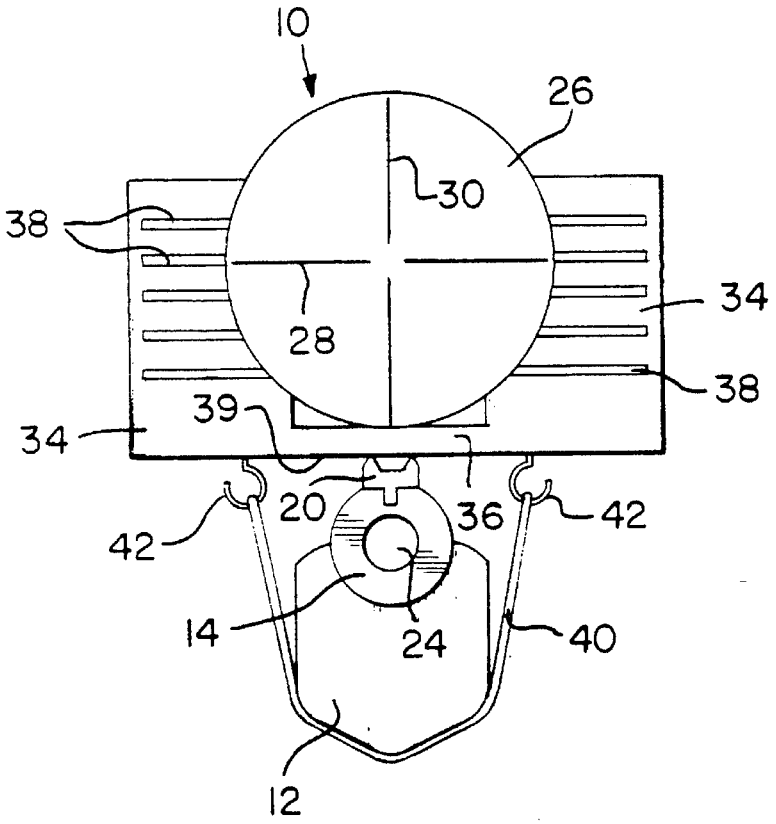
FIG. 4
FIG. 6
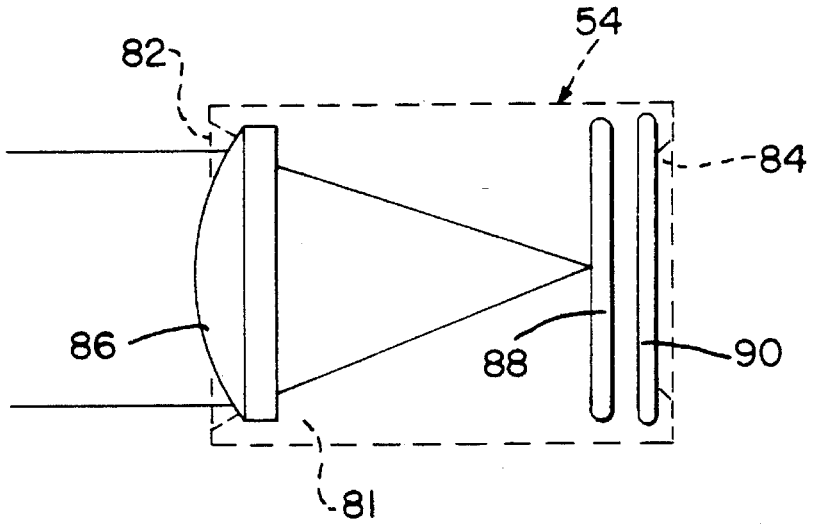

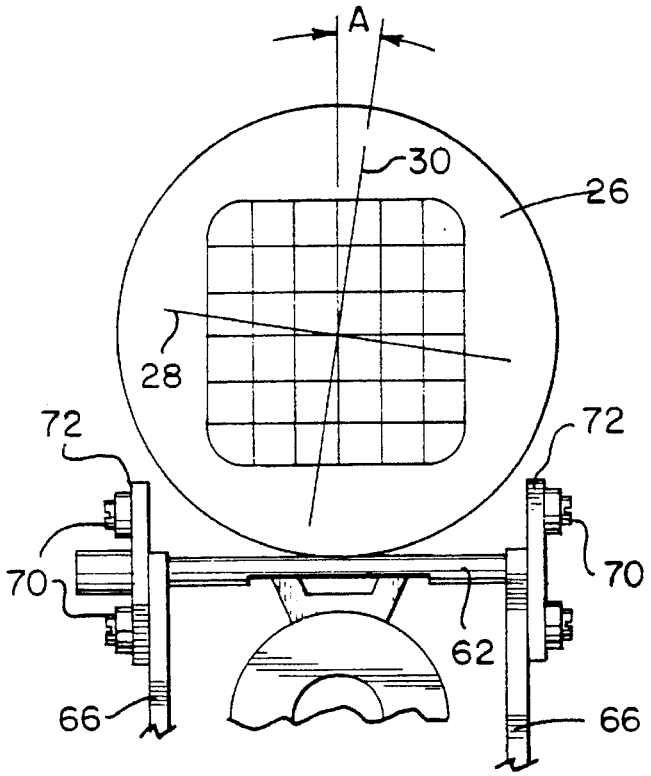
FIG. 9
FIG. 10
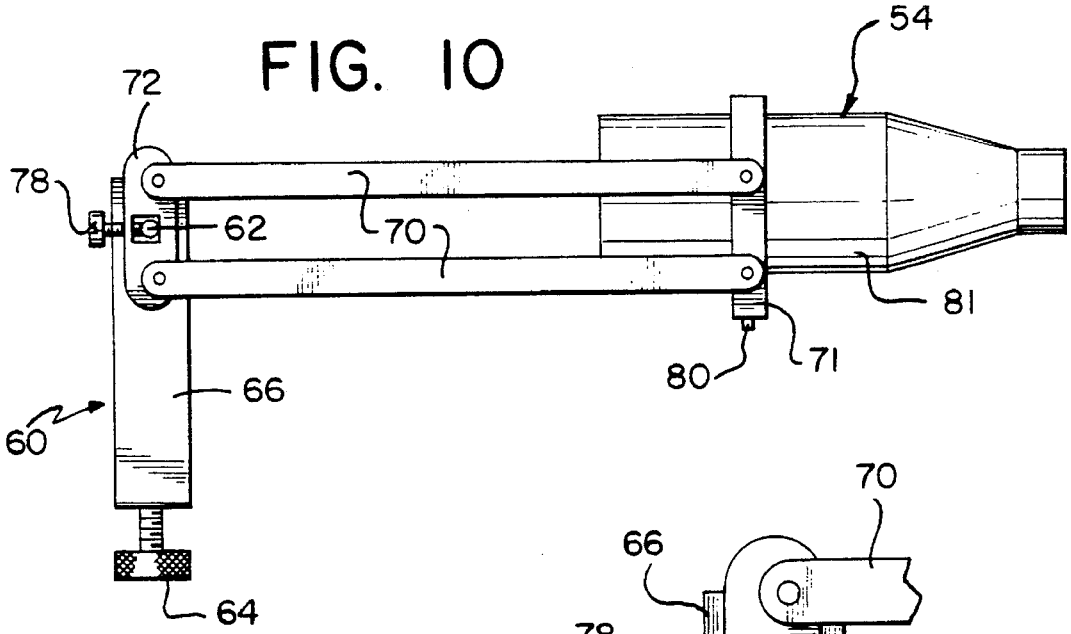
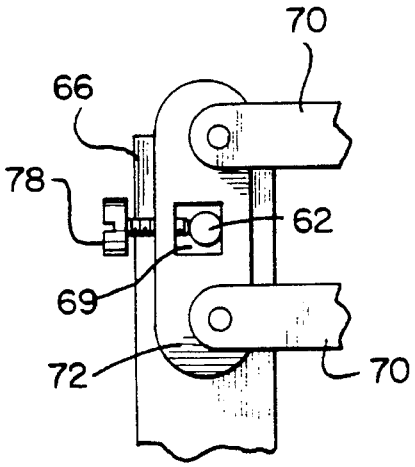
FIG. 11

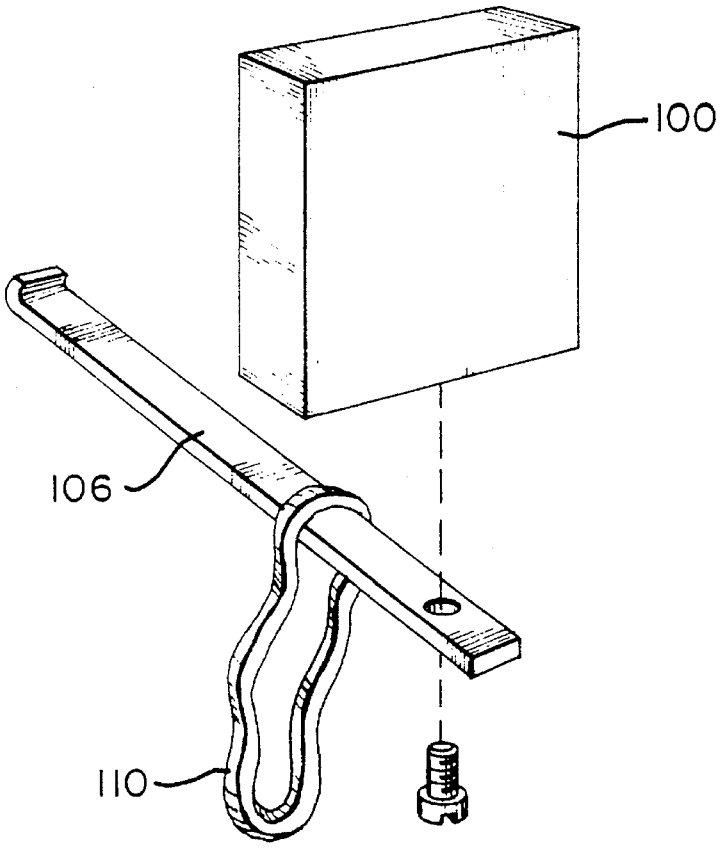
FIG. 14
FIG. 15
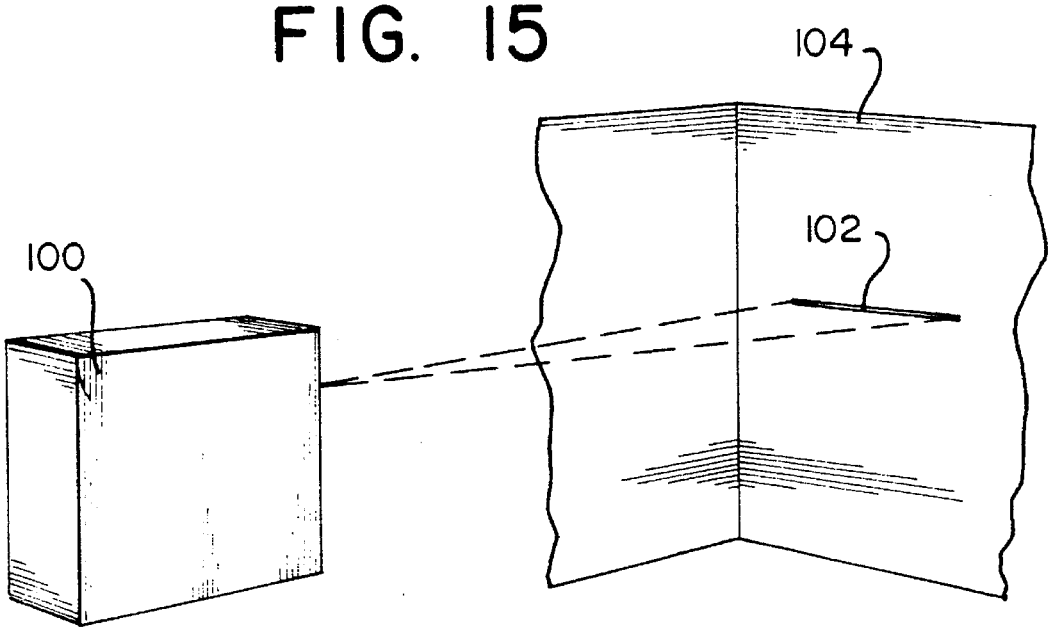

FIG. 16
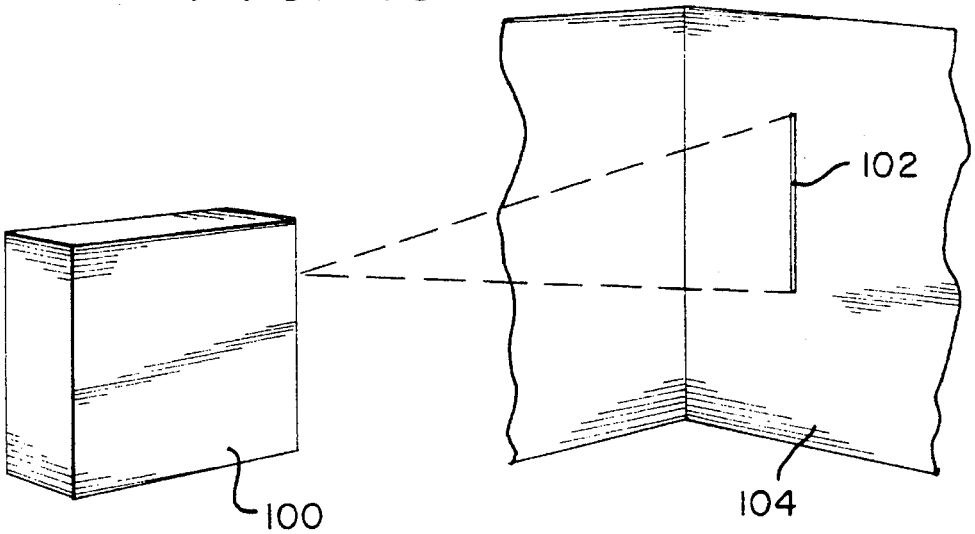
FIG. 17
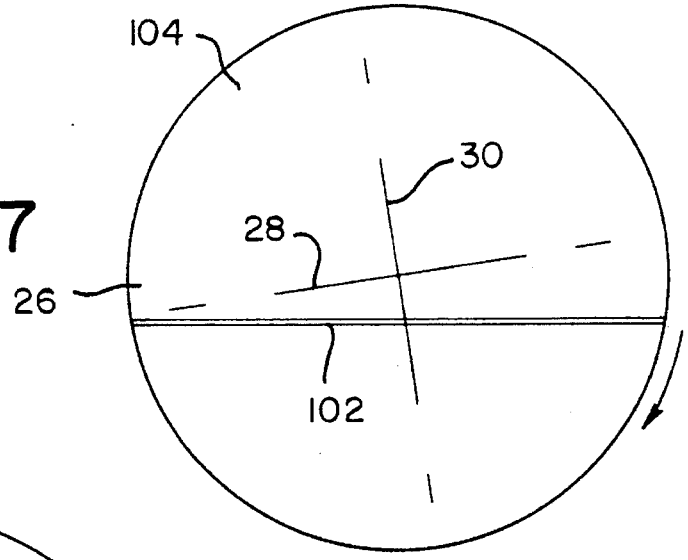
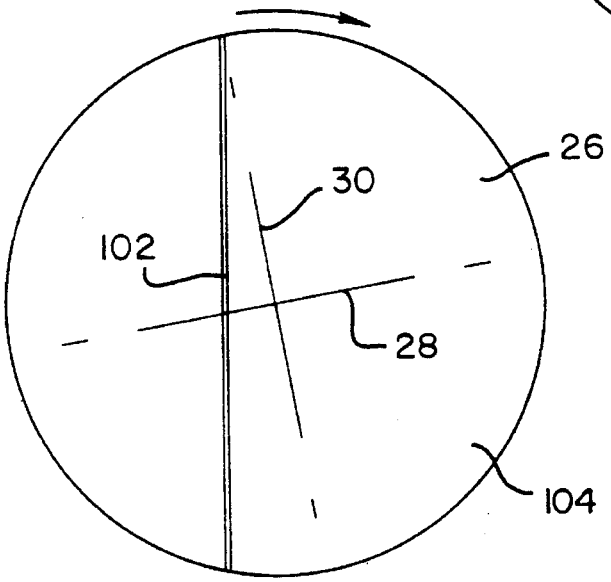
FIG. 18

PORTABLE RETICLE ALIGNMENT DEVICE FOR FIREARMS

This is a continuation in part of U.S. patent application, Ser. No. 08/092,395, filed: Jul. 15, 1993, currently pending.

FIELD OF THE INVENTION

This invention generally relates to alignment devices for aligning the reticle of a telescopic sight, and more particularly, to alignment devices used to true the cross-hairs of the reticle with respect to the barrel axis of a firearm to eliminate any "canting" of the mounted telescopic sight.

BACKGROUND OF THE INVENTION

A typical telescopic sight for use with a firearm includes a reticle having centrally located cross hairs, i.e., a vertical centerline and a horizontal centerline. For the most part, telescopic sights include adjustment controls enabling the operator of the firearm to make several main adjustments to the telescopic sight relative to firearm. Three of these adjustments are an elevation adjustment of the horizontal hairline, i.e., movement of the horizontal hairline up or down, a lateral adjustment of the vertical hairline, i.e., left or right, and a rotational adjustment of the entire telescopic sight about the central axis of the telescopic sight.

The elevation adjustment is used to compensate for the arched path a fired projectile (bullet) will inherently follow from the muzzle of the firearm to the target. Once the elevation of a sight is properly adjusted for a given range, the intersection of the cross-hairs of the reticle will indicate a theoretical point of impact of the bullet at that range, even though the line of fire to the target, that is the actual path of the bullet, will not align with the line of sight (the straight line extension of the central axis of the telescopic sight to the target).

The lateral adjustment is used primarily for initial sighting, and also to compensate for any expected drift (left or right) by the bullet from the line of fire caused by cross winds between the firearm and the target.

The process of making elevation and windage adjustments to the sight of a firearm is called "sighting in". Typically, both adjustments never remain consistent and are often difficult to adjust accurately prior to test-firing the firearm.

Apart from collimating the sight with the firearm, the mounted telescopic sight is rotatable about its central axis to adjust the relative position of the cross hairs of the sight with respect to the longitudinal and vertical axis of the barrel of the firearm. The adjustment is made to ensure that the vertical cross hair of the sight coincides with the vertical axis of the firearm. This adjustment may be easy made using a padded vice or cradle and a machinist's level and a known vertical reference line. However, in the field, this adjustment has been proven to be quite difficult to execute accurately due to the lack of a known vertical reference line with respect to the bore axis of the barrel of the firearm.

One common method used to attempt to align the vertical cross hair of the sight with respect to the bore axis of the firearm includes holding the firearm perfectly level with respect to the ground and then "sighting in" on a reference line, such as the edge of a building or a telephone pole which is known vertical with respect to the ground. With this method, the telescopic sight is simply rotated until the reference line and the vertical cross hair align. Unfortunately, however, this method is rarely successful because without the previously mentioned machinist's level and padded vise there is no indication of when the firearm is being held truly level with respect to the ground. Since it is common to hold a firearm, such as a rifle, at a slight tilt or cant, any adjustment to the reticle will reflect the angle of the cant and will invariably fail to be truly aligned with the bore axis of the barrel of the firearm.

The problem with aligning the vertical hairline with respect to the bore axis of the firearm is that there is no fixed reference line against which such an adjustment may be accurately and easily made. Conventional mounts for mounting a sight to a firearm do not restrict or otherwise provide "self-alignment" of the mounted sight with respect to the bore axis of the firearm. Any reference line located on the sight will not remain (or may never be) consistently aligned with respect to the bore axis of the firearm, and therefore may not be used to properly adjust the hairlines of the reticle with respect to the bore axis of the firearm.

Devices are commercially available to enable the user of a firearm to collimate the mounted sight of the firearm for a given target range and windage, prior to the firing of any bullets. U.S. Pat. Nos. 3,908,282, 3,744,133, 3,112,567 and 4,095,347 disclose collimators for aiding in the proper adjustment of a telescopic sight mounted to a firearm, and include an alignment reticle and a weight which are together pivotally connected to a bore mount. During collimation, the devices of the above-listed prior art references are attached to the firearm within the bore of the barrel allowing gravity to draw the weight downward and the opposing alignment reticle upward, above the barrel of the firearm and into the line of sight. All the necessary adjustments to the sight may be made by visually "sighting in" the cross-hairs of the sight against the alignment reticle. Unfortunately, the rotation adjustment of the reticle of the sight may not be accurately made using the prior art devices of the above-listed references because the alignment reticle is aligned only with respect to gravity and not the bore axis of the firearm. During collimation, the firearm may be easily held in a canted position, in which case the cross-hairs of the reticle of the sight would be misaligned with respect to the bore axis of the firearm. This misalignment between the cross-hairs of the reticle and the bore-axis of the firearm may easily result in inaccurate firing and difficult re-adjustment of the scope after a test firing.

A reticle alignment device is available from the B-Square Company of Fort Worth, Texas, which comprises a bent piece of clear plastic which is approximately rectangular in cross section and includes a horizontal portion which is sized to roughly fit into the receiver of bolt-action rifles. Once inserted within the receiver of the rifle, the horizontal portion of the device aligns on the bolt-way flats. A vertical portion of the device, which includes a reference line, projects upward from the receiver just in front of the eyepiece of the sight. The user may align the vertical cross hair of the sight with the reference line provided by the B-Square device.

The B-Square alignment device may only be used with bolt-action type rifles having a particular arrangement of bolt-way flats and not with any other type of action (pump, auto, single shot, etc.). Even in those situations where the B-Square device may be used, it is often difficult to accurately align the fine cross hairs of the sight with the overlapping reference line of the B-Square device because the reference line interferes with the line of sight, being positioned exactly where the reference line should be. In adjusting the sight using the B-Square, the user loses sight of the vertical cross hair behind the interfering reference line when the cross hair nears the correct position but is not necessarily at the correct position.

It is, therefore, an object of the present invention to provide an easy-to-use reticle alignment device which overcomes the problems of the prior art.

Another object of the invention is to provide an easy to use device for quickly aligning the cross-hairs of the reticle of a firearm-mounted telescopic sight with respect to the bore axis of the firearm.

A still further object of the invention to provide a reticle alignment device which has not-interfering reference lines for aligning the cross-hairs of the reticle of a firearm-mounted telescopic sight with respect to the bore axis of the firearm.

SUMMARY OF THE INVENTION

A device for aiding in the cross-hair alignment of the reticle of a gun-mounted telescopic sight wherein the gun includes at least one scope base for securing the telescopic sight. The device includes a light source for projecting a beam of light against a surface. The light source is mounted to the scope base of the gun. The projected light beam is modified to form a reference line which may be viewed through the telescopic sight. The projected reference line is automatically aligned with the barrel axis of the gun. One of the cross-hairs of the reticle of the telescopic sight may be compared with the aligned projected reference line and adjusted accordingly to align the cross-hairs with the barrel axis of the gun.

BRIEF DESCRIPTION OF THE DRAWINGS

FIG. 4 is a front view of the telescopic sight and a mounted alignment device showing the cross hairs of the sight aligned with reference marks located on the alignment device in accordance with the first embodiment of the invention;

FIG. 6 is an illustrative sectional view of an optical assembly of the reticle adjustment device of FIG. 5;

FIG. 9 is a front view of the misaligned cross-hairs of FIG. 2 showing the alignment device of FIG. 5 mounted to the firearm, as viewed through the scope and in accordance with the second embodiment of the invention;

FIG. 10 is a side view of the reticle adjustment device of FIG. 5, in accordance with the second embodiment of the invention;

FIG. 11 is an enlarged partial side view of a connecting linkage of the reticle adjustment device of FIG. 10, in accordance with the second embodiment of the invention;

FIG. 14 is an exploded view of the mounting assembly used to attach the laser line generator to the scope base of the gun;

FIG. 15 is a perspective view of the laser line generator and a viewing surface showing a projected horizontal reference line;

FIG. 16 is a perspective view of the laser line generator and a viewing surface showing a projected vertical reference line;

FIG. 17 is a representative view through a telescopic sight mounted to the gun showing misaligned cross-hairs and a properly aligned horizontal projected reference line; and FIG. 18 is a representative view through a telescopic sight mounted to the gun showing misaligned cross-hairs and a properly aligned vertical horizontal projected reference line.

Figure 1:
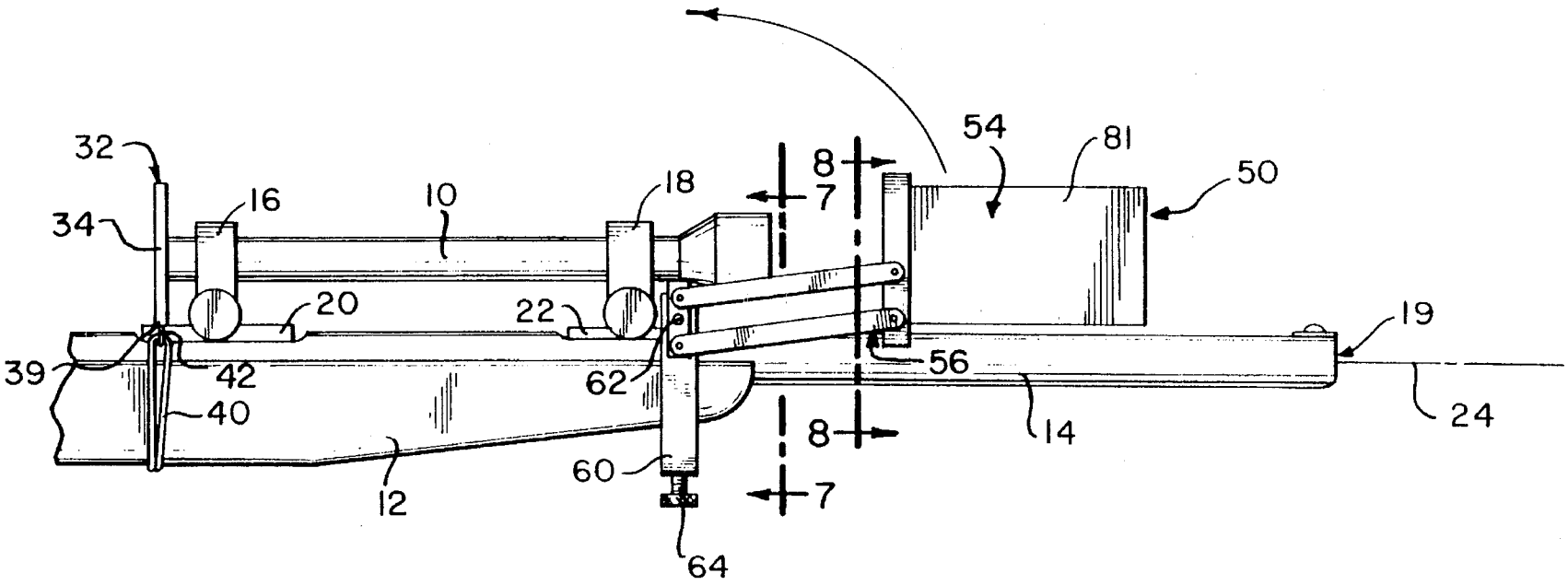
FIG. 1 is a partial side view of a firearm having a telescopic sight and showing the mounted positions of two reticle adjustment devices, in accordance with first and second embodiments of the invention.

DETAILED DESCRIPTION OF THE PREFERRED EMBODIMENT:

Referring to FIG. 1, a telescopic sight 10 is mounted to a rifle 12. The scope-sight 10 is secured to the barrel 14 of the rifle 12 by a rear mount 16 and a front mount 18. The front mount 18 is closest to the muzzle 19 of the barrel 14. The rifle 12 includes a rear scope base 20 and a front scope base 22. The scope bases 20, 22 are machined into or are otherwise attached to the top portion of the barrel 14 to be aligned with a bore axis 24 of the barrel 14. The rear and front scope bases 20, 22 are adapted to receive their respective rear and front mounts 16 and 18.

The invention indirectly or directly uses the machined and "true" scope bases 20, 22 on the barrel 14 to provide an accessible reference line for aligning the cross hairs (28, 30) of a reticle 26 of the scope-sight 10 with respect to the bore axis 24 of the barrel 14.

Figure 2:
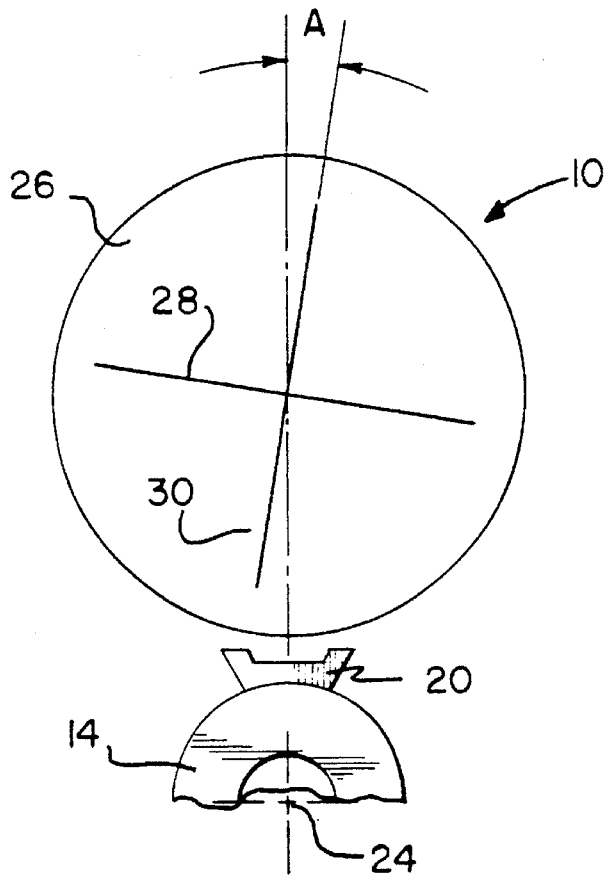
FIG. 2 is a illustrative front view of the cross-hairs of a misaligned reticle of the telescopic sight as viewed through the sight.

FIG. 2 illustrates typical canted cross-hairs (28, 30) of the reticle 26 of a scope-sight 10. The cross hairs are canted or tilted from an accepted "true vertical" reference line by an angle "A". The cross-hairs include a horizontal cross hair 28 and a vertical cross hair 30. The front scope base 20 is shown as a reference of "true vertical" with respect to the bore axis 24 of the barrel 14.

Figure 3:
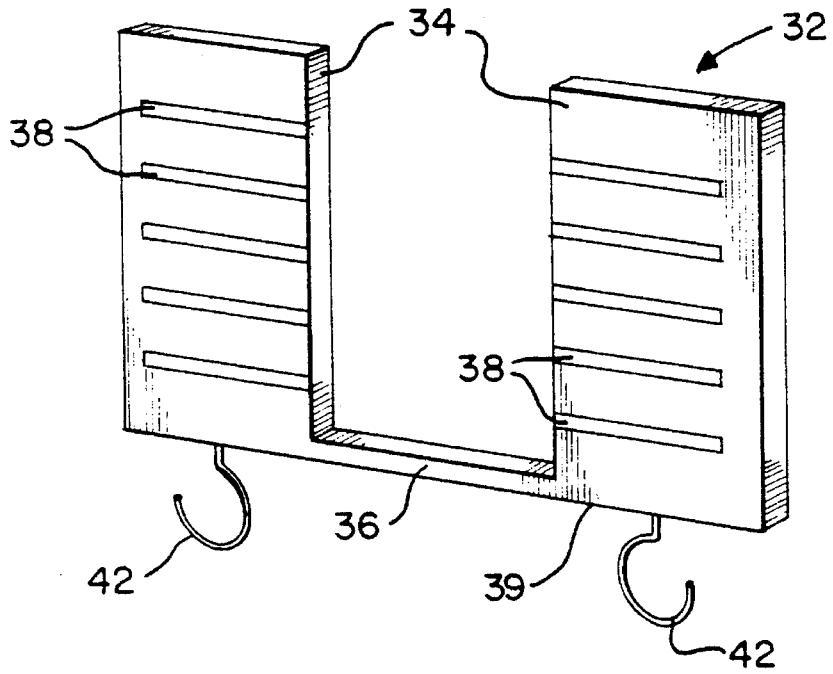
FIG. 3 is a perspective view of a reticle adjustment device in accordance with the first embodiment of the invention.

An alignment device 32, in accordance with a first embodiment of the invention is shown in FIG. 3. The device 32 includes preferably two opposing reference cards 34 connected to each other within a common plane by a connecting bar 36. The reference cards 34 both include aligned parallel reference lines 38. The connecting bar 36 is preferably made from a bar stock having a square or rectangular cross section which provides a flat surface 39. The connecting bar 36 is parallel to the reference lines 38 of the reference cards 34. A hook 42 is connected to a lower portion of each reference card 34 for receiving each respective end of a rubber band 40. The rubber band 40 is used to provided quick and easy securement to the rifle 12, as described below.

The alignment device 32 is attached to the front or rear scope base 20, as shown in FIGS. 1 and 4, so that the two opposing reference cards 34 appear on either side of the reticle 26. The connecting bar 36 is positioned on the one of the scope bases and held there by the rubber band 40, which is looped from a first hook 42, around the barrel 14 (and stock section) of the rifle 12 to the other hook 42. The elastic contracting force generated by the rubber band 40 looped around the rifle, as described, draws the flat surface 39 of the connecting bar 36 into flush contact with the flat surface of the front scope base 20. Since the scope base 20 is "true" with the bore axis 24, then both the mounted connecting bar 36 and each of the reference lines 38 will likewise be "true" with the bore axis 24. The flat surface 39 of the connecting bar 36 maintains the entire alignment device 32 in an upright position.

Once the alignment device 32 shown in FIG. 3 is properly attached to the either scope base 20, 22 of the rifle 12, as shown in FIG. 4, the reticle 26 may be easily aligned with the bore axis 24 by rotating the telescopic sight 10 until the horizontal cross hair 28 is parallel with the reference lines 38. This is easily accomplished while sighting through the scope-sight 10 and simultaneously comparing the horizontal cross hair 28 of the reticle 26 with the exposed reference lines 38 displayed on either side of the eyepiece of the scope-sight 10.

Figure 5:
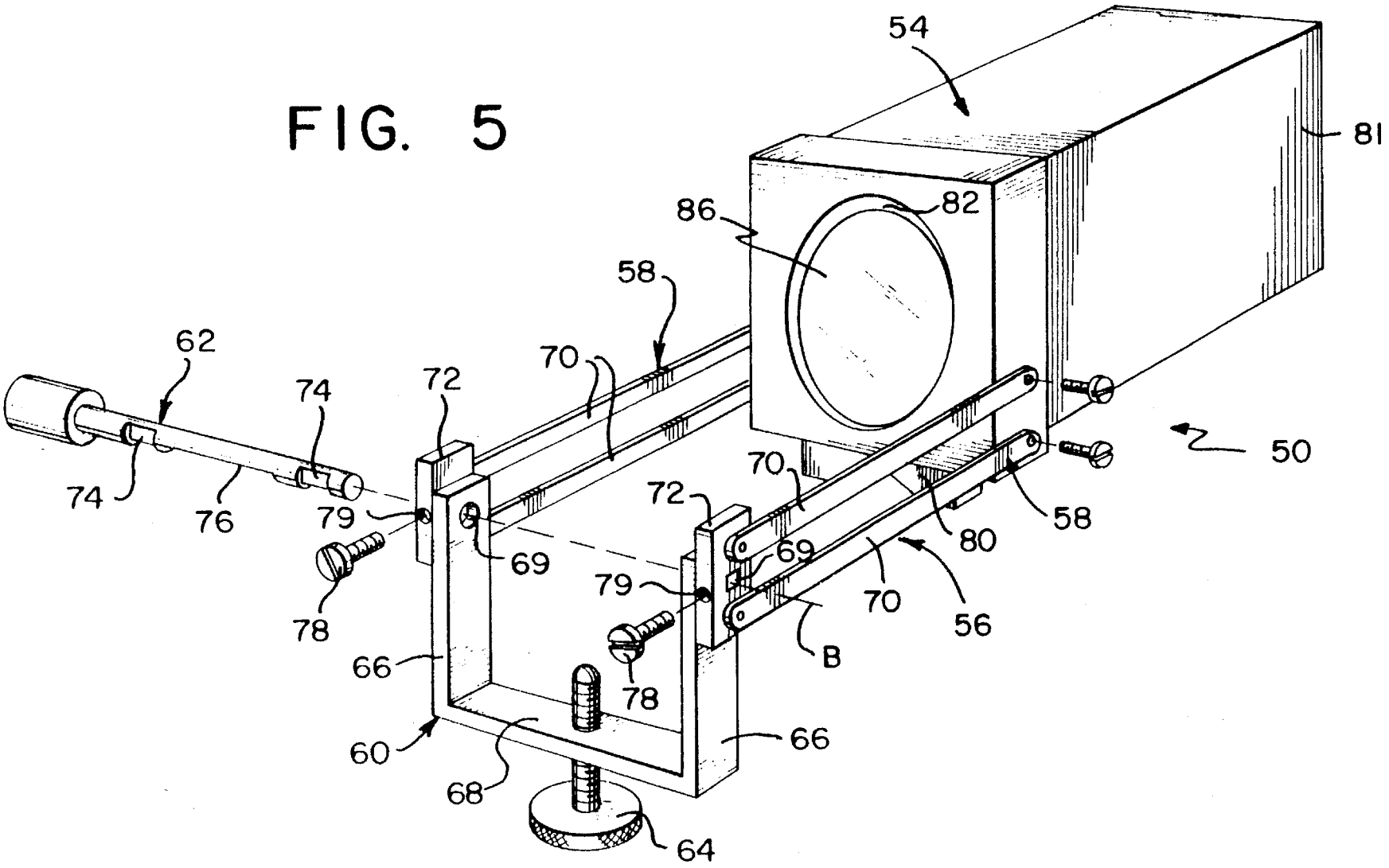
FIG. 5 is a perspective view of a reticle adjustment device in accordance with a second embodiment of the invention.

Referring to FIG. 5, another alignment device 50 is shown, in accordance with a second embodiment of the invention. As in the above described alignment device 32, the alignment device 50 is mounted to one of the scope bases, and therefore automatically aligns with the bore axis 24 of the barrel 14. The alignment device 50 provides reference lines which are entirely viewed through the sight 10.

The alignment device 50 includes an optical assembly 54 and a mounting assembly 56. The mounting assembly 56 is used to secure the optical assembly 54 to the rifle 12 in an aligned orientation with respect to the bore axis 24 of the barrel 14. The alignment device 50 is shown in a mounted position on the rifle 12 in FIG. 1.

The mounting assembly 56 includes two parallelogram assemblies 58, a mounting bracket 60, a contact bar 62 and a tightening screw 64. The mounting bracket 60 is preferably "U" shaped defining two vertical sections 66 connected to each other by a bottom section 68 and open at upper ends.

Each parallelogram assembly 58 includes a pair of parallel connecting bars 70 and a pivot block 72. One end of each connecting bar 70 of each parallelogram assembly 58 are pivotally connected to a respective pivot block 72. The remaining two ends of the two connecting bars 70 of each parallelogram assembly 58 are pivotally connected to a portion of the optical assembly 54 (either directly as shown in FIG. 5, or indirectly using a collar 71, as shown in FIG. 10 and further described below) so that each connecting bar 70 is parallel to the remaining three.

Each pivot block 72 includes a bore 69 which aligns with similar bores 69 located in both vertical sections 66 of the mounting bracket 60. These aligned bores 69 define an axis "B" along which the contact bar 62 may be inserted. Once inserted, the contact bar 62 directly connects each pivot block 72 to the mounting bracket 60, as further described below.

With the mounted assembly 56 in its mounted position on the rifle 12, as shown in FIG. 1, the contact bar 62 is positioned along the axis "B" and is parallel to and slightly longer than the lower section 68 of the mounting bracket 60 and thereby extends past either side of the vertical sections 66.

The contact bar 62 includes two vertical flat surfaces 74 and a central horizontal flat surface 76. The horizontal flat surface 76 engages with the front scope base 22 and extends the "true" orientation of the scope base 22 to the entire mounting bracket 60 so that the mounting bracket 60 becomes an aligned reference to the central bore axis 24 of the firearm.

The vertical flat surfaces 74 align with each respective pivot block 72. Each pivot block 72 are securely fastened to each respective vertical surface 74 of the contact bar 62 and thereby become mechanically aligned with each other and the central bore axis 24 of the firearm. In this preferred embodiment, securing screws 78 are used to engage threaded bores 79 located in the pivot block 72 so that each pivot block 72 may be selectively secured to each respective vertical flat surface 74 of the contact bar 62.

The parallelogram assemblies 58, each being mechanically restricted to pivotal movement within a vertical plane controlled by each respective pivot block 72, will also be mechanically aligned with the bore axis 24 of the rifle 12.

Being mechanically connected to the parallelogram assemblies 58 and the mounting bracket 60, the entire optical assembly 54 becomes automatically aligned with the bore axis 24 of the rifle when the contact bar 62 is positioned on the "true" surface of the front (or rear) scope base 22. The purpose of the parallelogram assemblies 58 is to give the optical assembly 54 freedom of movement along the vertical plane extending through the bore axis 24 while remaining aligned with the bore axis 24 of the rifle 12 and maintaining automatic alignment with the bore axis of the scope. This freedom of movement of the mounted optical assembly 54 allows for automatic alignment between the bore axis of the mounted scope and the front opening 82 of the optical assembly 54, regardless of the distance between the bore axis of the mounted scope 10 and the barrel 14 of the rifle 12.

Figure 8:
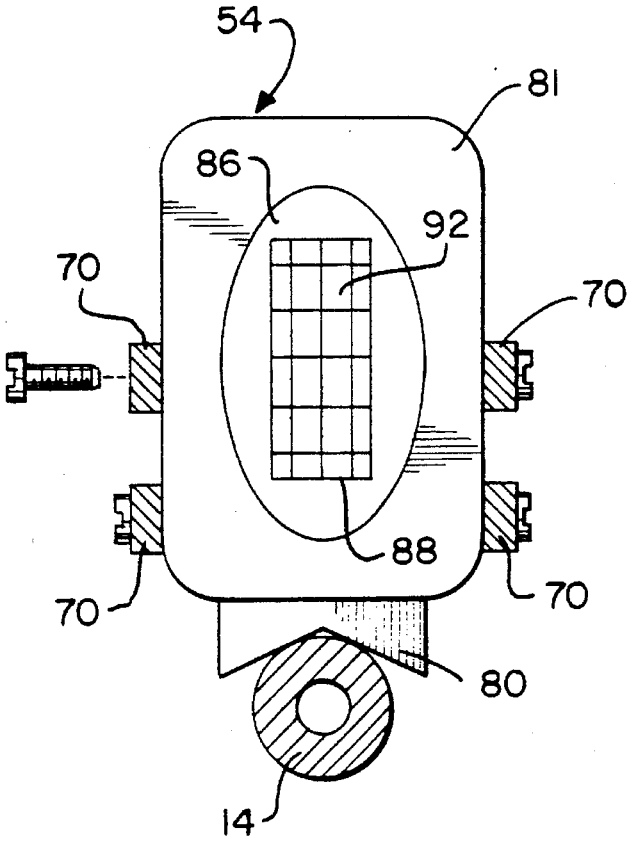
FIG. 8 is a front view of the optical assembly of the reticle adjustment device of FIG. 5, taken along the lines 8—8 of FIG. 1.

As shown in FIG. 5 and 8, a contact foot 80 is preferably provided below the optical assembly 54 (or the collar 71 of FIG. 10) to assist in supporting the aligned optical assembly 54 while mounted to the rifle. The contact foot 80 includes an inverted "V" shaped groove which automatically engages and centers the rifle barrel 14.

Referring to FIGS. 5 and 6, the optical assembly 54 includes an elongated housing 81 having a front opening 82 and a rear opening 84, a lens 86, a translucent reticle screen 88 and a translucent frosted screen 90. The lens 86 is mounted within the housing across the front opening 82. The frosted screen 90 is mounted within the housing 81 across the rear opening 84. The reticle screen 88 is mounted within the housing 81 between the lens 86 and the frosted screen 90 within the focal plane of the lens 86.

Once properly positioned on the rifle, as described below, the optical assembly 54 of the alignment device 50 illuminates an aligned reticle pattern 92 which may be viewed through the scope-sight 10. The reticle pattern 92 is located on the translucent reticle screen 88. Ambient light enters the housing 81 from the rear opening 84 and is diffused by the frosted translucent screen 90. The diffused light illuminates the reticle pattern 92. The image of the reticle pattern 92 passes through the lens 86 to be viewed by the user through the scope-sight 10.

The user may easily align either the horizontal or the vertical cross hair of the mounted sight 10 with the superimposed "true" reticle pattern 92 so that the cross hairs of the sight become "true" with respect to the bore axis 24 of the rifle 12.

In another related embodiment, as illustrated in FIGS. 12–18, a laser line generator 100 is used to project a reference line 102 of light against a nearby planar surface 104, such as a wall or the side of a building. The laser line generator 100 is a commercially available product which is used to project straight lines of laser light. The laser line generator 100 includes a source of laser light, usually a diode-type laser, a power supply, a power switch, appropriate operating circuitry, and a lens which shapes and diverges the light output of the laser diode in one plane so that a single beam of light is projected as a vertical or horizontal line of light. The elements which make up the laser line generator 100 are known to those of ordinary skilled in the art and further detail of these elements is not required for one of ordinary skill in the art to understand and carry out the present invention. It is for this reason that the specific elements which make up the laser line generator 100 are not shown in the figures.

The laser line generator, which, for example, is commercially available through Edmund Scientific located in Barrington, N.J., as item no. D39920 produces a beam as a straight reference line 102. In accordance with this embodiment of the invention, the reference line 102 is used to align either the vertical or horizontal reference line of the reticle 26 of the telescopic sight 10. The laser line generator 100 is attached to a support bar 106 which is, in turn, secured to a rifle or gun 12 so that the projected reference line 102 from the laser line generator 100 is projected "true" or aligned with the bore axis 24 of the firearm. The projected reference line 102 effectively functions as one of the reference lines 38 located on the alignment device 32 described above in a related embodiment and shown in FIG. 3.

Figure 7:
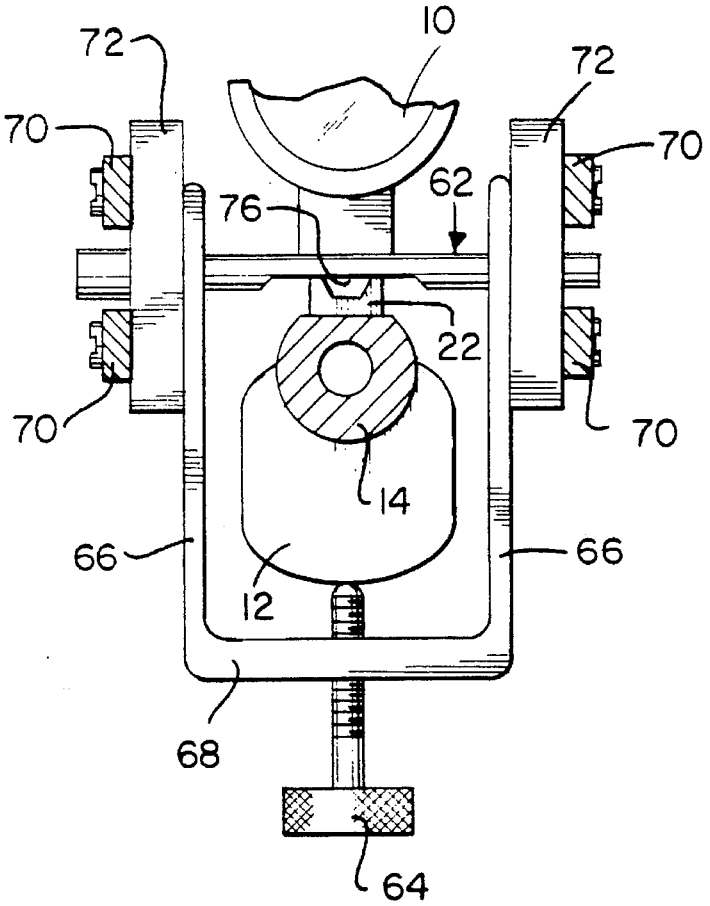
FIG. 7 is a front view a mounting assembly of the reticle adjustment device of FIG. 5, taken along the lines 7—7 of FIG. 1.

To ensure that the projected line 102 from the laser line generator 100 is aligned with respect to the bore axis 24 of the gun 12, the support bar 106 is mounted to the gun 12 along the upper surface of one of the two scope bases 20, 22 in a similar manner as the alignment device 32 is attached to the upper surface of the scope base 20 in a previously described embodiment shown in FIGS. 4 and 7.

Figure 12:
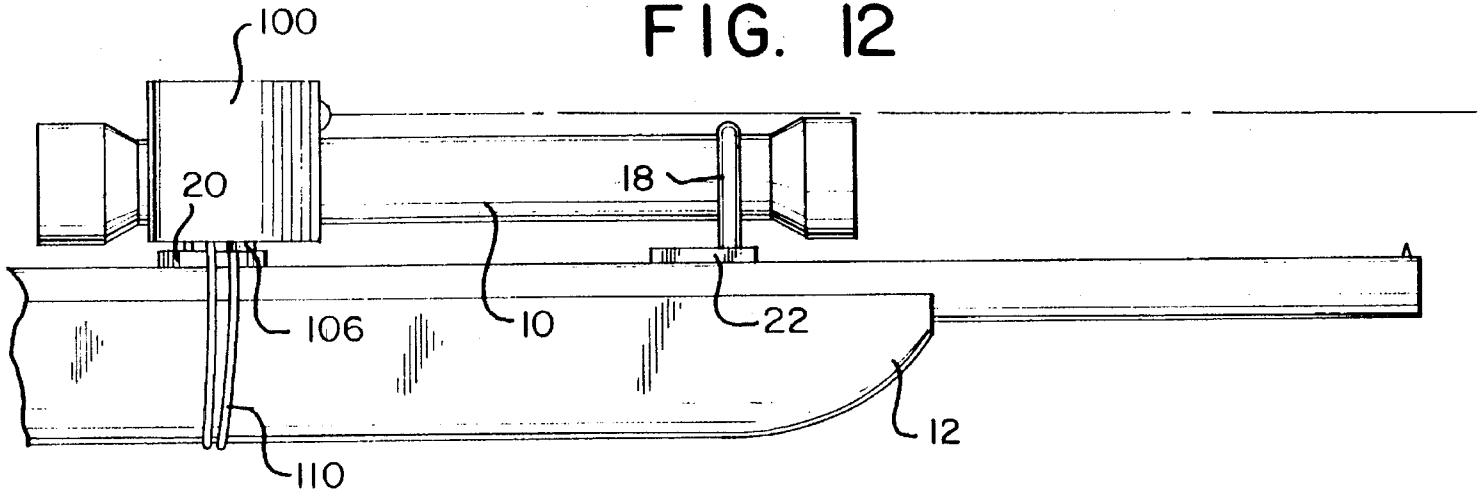
FIG. 12 is a partial side view of a gun with a laser line generator in a mounted position, in accordance with another embodiment of the invention.
Figure 13:
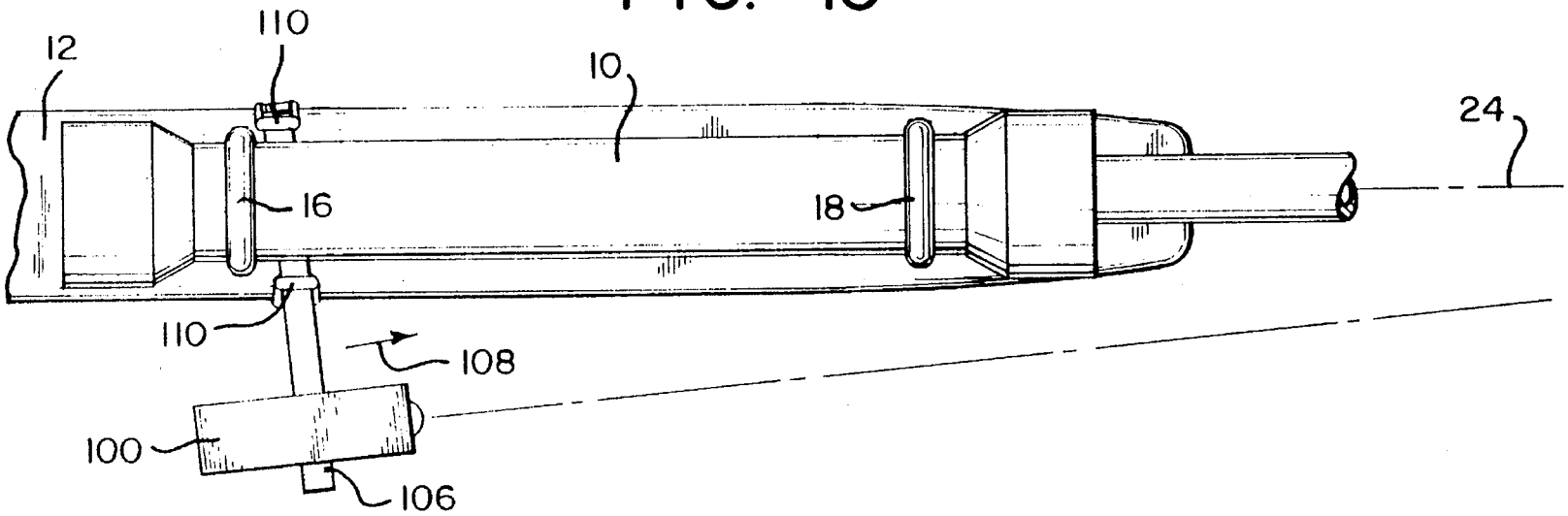
FIG. 13 is a partial top view of FIG. 12, showing a projected beam from the laser line generator.

The support bar 106 may be secured to the upper surface of the scope base 20 in any appropriate manner including the use of an elastic band 110, as shown in FIGS. 12–14, which extends around the firearm and draws the support bar 106 tightly against the scope base 20. Alternatively, the C-clamp version shown in FIG. 7 could be used, depending on the weight of the laser line generator 100 and the type of gun being used wherein the laser line generator 100 is attached to a portion of the C-clamp assembly 66 or along the contact bar 62.

Once in position on the scope base 20, the support bar 106 may be displaced slightly, as indicated by the arrow 108 in FIG. 13 so that the projected output beam of light from the laser line generator 100 may be positioned on a nearby viewing surface within or adjacent to the line of sight of the telescopic sight 10 mounted on the gun 12.

Although it is preferred in this embodiment that the source of projected light is coherent laser light, other appropriate light sources may be used, including light generated from a tungsten filament bulb, such as the light from a flashlight.

In use, once the laser line generator 100 is mounted to the gun on the scope base 20 and turned on, the resulting projected reference line 102 may be directed to a wall surface, for example, 104 so that it may be viewed through the telescopic sight adjacent to the cross-hairs of the reticle of the sight. The telescopic sight may be rotated until its cross-hairs become parallel with the projected reference line 102 viewed on the wall surface 104, as illustrated in FIGS. 15 and 16, at which point the cross hairs will be aligned with the bore axis 24 of the gun.

What is claimed is:

1. A device for aiding in the cross-hair alignment of the reticle of a gun having a gun barrel including a longitudinal barrel axis and a telescopic sight attached to said gun on at least one scope base, said telescopic sight having a viewing end and a reticle with at least one sighting hairline, said device comprising:

a source of light for producing a beam of projected light;

means for modifying said beam of projected light to form a projected reference line; and said source of light including means thereon for securing said source of light directly to said at least one scope base of said gun so that said projected reference line is automatically aligned with the axis of the barrel of said gun, said source of light being offset from the optical axis of said telescopic sight such that said projected reference line may be viewed through said telescopic sight so that the orientation of said at least one sighting hairline of said reticle may be compared with said projected reference line and adjusted to align the telescopic sight with the barrel axis of the gun.

* * * * *